US006612732B2

(12) United States Patent
Blakeman, II et al.

(10) Patent No.: US 6,612,732 B2
(45) Date of Patent: Sep. 2, 2003

(54) PAINT MIXER

(75) Inventors: Robert D. Blakeman, II, Chicago, IL (US); William A. Miller, Buffalo Grove, IL (US); John Martin Kossel, Lindenhurst, IL (US)

(73) Assignee: Fluid Management, Inc., Wheeling, IL (US)

( * ) Notice: Subject to any disclaimer, the term of this patent is extended or adjusted under 35 U.S.C. 154(b) by 102 days.

(21) Appl. No.: 10/041,795

(22) Filed: Oct. 19, 2001

(65) Prior Publication Data

US 2003/0076738 A1 Apr. 24, 2003

(51) Int. Cl.[7] ..... B01F 11/00
(52) U.S. Cl. ..... 366/209; 366/605
(58) Field of Search ..... 366/208–218, 366/347, 605, 108, 110, 111, 112, 348; 312/293.2, 325–329, 139.1; 220/252, 826

(56) References Cited

U.S. PATENT DOCUMENTS 653,695 A * 7/1900 Raff
1,080,478 A * 12/1913 Reis
1,853,528 A * 4/1932 Zademach
2,017,485 A * 10/1935 Yawman
2,428,839 A * 10/1947 Di Salino
2,804,122 A * 8/1957 Baum
2,895,600 A * 7/1959 Nevins
4,334,629 A * 6/1982 Koch et al.
4,568,194 A * 2/1986 Gargioni
5,383,163 A * 1/1995 Brunn
5,711,601 A * 1/1998 Thomas et al.
5,957,577 A * 9/1999 Dickson et al.

* cited by examiner

*Primary Examiner*—Charles E. Cooley
*Assistant Examiner*—David Sorkin
(74) *Attorney, Agent, or Firm*—Marshall, Gerstein & Borun

(57) ABSTRACT

An improved paint mixer is disclosed which includes a base and an upper cabinet pivotally connected to the base. The upper cabinet can be pivoted from a first rearward position which provides access to a front section of the base and a second forward position which provides access to a rear section of the base. As a result, both the front and rear section of the base are easily accessible for service, maintenance, and cleaning. A support system that includes three adjustable legs provides improved support and stability. Casters disclosed at the rear end of the bottom of the base along with a recessed wall of the base and a handle disposed at the front of the base make it easier to move and/or relocate the mixer. Non-stick coatings in the form of a paint-resistant coating or an anti-graffiti coating to the inside surfaces of the mixer facilitate the removal of accumulated paint.

27 Claims, 3 Drawing Sheets

FIG. 1
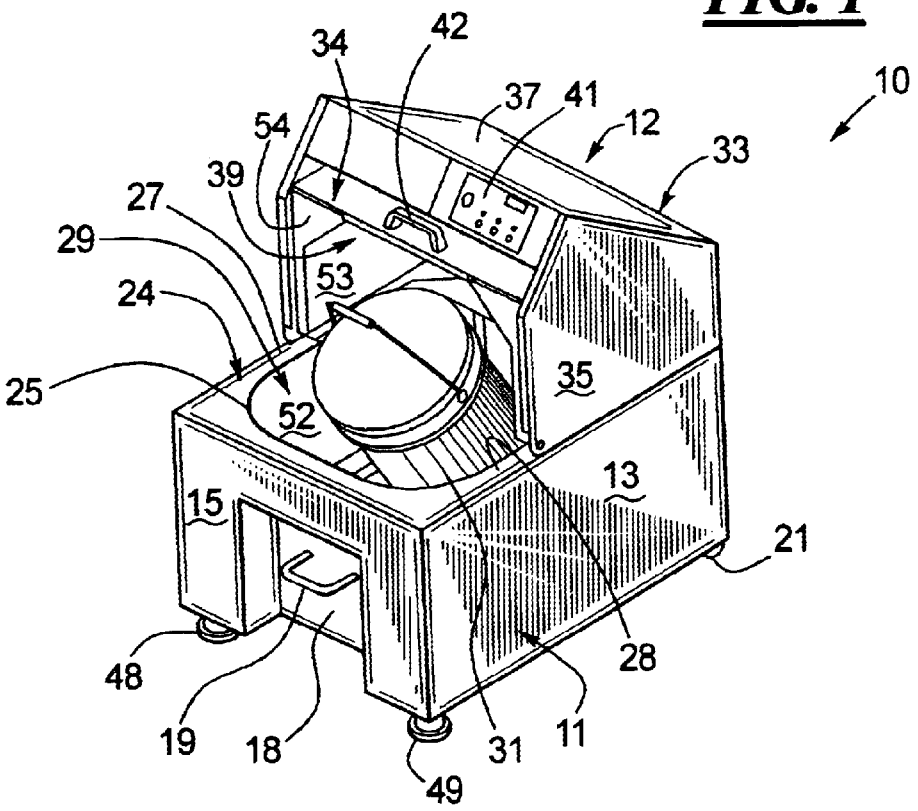
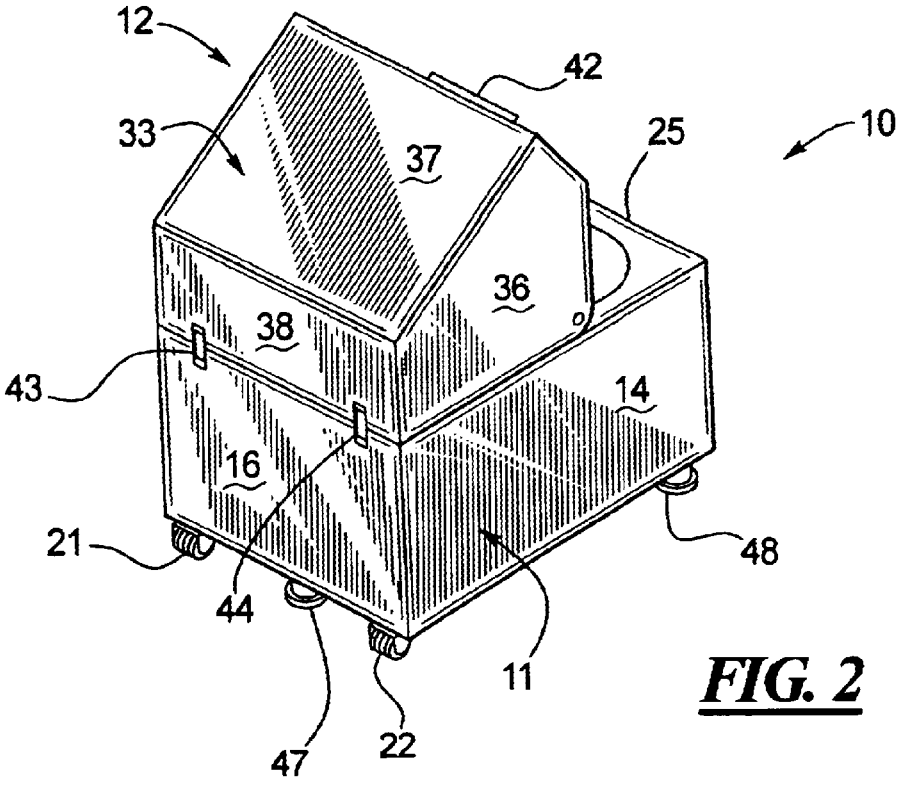
FIG. 2

PAINT MIXER

TECHNICAL FIELD

A motorized paint mixer is disclosed. More specifically, a paint mixer that includes an upper cabinet that is pivotally connected to the base is disclosed which enables the upper cabinet to pivot between two positions thereby providing improved access to the motor, belt and other working components of the paint mixer for service and maintenance.

BACKGROUND OF THE RELATED ART

Motorized paint mixers are known. Specifically, typical motorized paint mixers include a base structure having a motor, belt and other components used to rapidly shake a can or pail of paint so that the paint can be sold to a customer in a thoroughly mixed condition. Most retail paint stores or hardware stores utilize one or more of these devices. Despite the longtime use of these devices, prior art paint mixers suffer from a number of deficiencies.

Specifically, currently available paint mixers are difficult to service because the motor, belt and other working components of the mixer are difficult to access and, accordingly, difficult to repair or maintain. Often, the enclosing cabinetry blocks access to the working components and the paint mixer must be at least partially disassembled during the maintenance process. As a result, the maintenance process is complicated and consumes additional time due to the problems in accessing the working components. Because a paint mixer imparts a violent vibrating or shaking motion to the can or pail of paint, paint mixers require periodic maintenance and therefore the maintenance of paint mixers is both time consuming and costly to the retailer.

Further, typical paint mixers are supported by four legs or foot pads. All four legs or foot pads must engage the floor or support at the same time. If the floor or support is not substantially planar, which is common in many hardware or paint stores having a cement floor, the legs or foot pads must be adjusted. If the adjustment to one of the legs or foot pads is off, the paint mixer will rock back and forth during operation thereby causing the paint mixer to move across the floor.

Further, typical paint mixers are heavy and difficult to move. Typical paint mixers do not have rollers or casters and therefore they can only be moved within a store using a hand cart or fork lift. Other mixers that do include casters, also include supporting legs that must be adjusted during installation to transfer the weight of the mixer from the casters to the support legs. In either case, adjustment of the support legs and movement of the mixer is time consuming and cumbersome.

Further, many paint containers may leak during the violent shaking that occurs during operation of the paint mixer. As a result, paint is sprayed to the interior surfaces of the mixer. The accumulation of paint inside the mixer is aesthetically unappealing and results in substantial build-up over time. The accumulated paint must eventually be removed which, again, is time consuming and therefore costly because the interior of prior art mixers is not easily accessible.

As a result, there is a need for an improved paint mixer design which is addresses the above deficiencies.

SUMMARY OF THE DISCLOSURE

In satisfaction of the aforenoted needs, an improved paint mixer design is disclosed which comprises a base comprising an open top leading to an interior space. The base further comprises a forward section and a rear section. The paint mixer also comprises an upper cabinet comprising a front cover that is pivotally connected to a back section. The upper cabinet, by way of either the back section or the front cover is pivotally connected to the base. The back section further comprises a front opening defined by a front edge as well as a lower edge that defines a bottom opening. The front and bottom openings of the back section lead into an open interior. The back section of the upper cabinet is pivotal between a first rearward position and a second forward position. In the first rearward position, the lower edge of the back section of the upper cabinet engages the rear section of the base to provide an enclosure for the rear section of the base while the front edge of the back section of the upper cabinet extends upward from the base so that the front opening of the back section of the upper cabinet faces forward. In the second forward position, the front edge of the back section of the upper cabinet engages the front section of the base to provide an enclosure for the front section of the base and the lower edge of the back section of the upper cabinet extends upward from the base so that the bottom opening of the back section faces rearward.

Thus, the upper cabinet pivotally connected to the base and can pivot from a first rearward position where the front section of the base is exposed and accessible. Further, the upper cabinet is pivotal to a second forward position where the rear section of the base is exposed.

Further, the front of the upper cabinet is pivotal between an open position and a closed position. In the open position, the front cover is accommodated in the open interior of the back section of the upper cabinet. When the back section is in the first rearward position and the front cover is in the open position, a paint container can be easily removed or installed in the paint mixer. The front cover is also pivotal to a closed position so that when the back section is in the first rearward position, the front cover extends down over the forward section of the base so that a lower edge of the front cover engages the forward section of the base thereby enclosing the front section of the base while the back section of the upper cabinet encloses the rear section of the base. When the front cover is in the closed position while the back section of the upper cabinet is concurrently in the first rearward position, the entire base is enclosed and the paint mixer is ready for operation.

In a refinement, the base further comprises a bottom surface that has three spaced apart adjustable supports for improved stability during operation. It has been found that the use of three spaced apart supports provides improved stability over the use of four spaced apart supports.

In a further refinement, the bottom surface of the base is also connected to two casters.

In yet a further refinement, the base further comprises a front wall having a lower end. The lower end of the front wall comprises a recess. The recess enables an operator or a service technician to place his or her toes within the recess to get closer to the mixer during movement of the mixer. To facilitate movement of the mixer, a handle may be included on the front wall of the cabinet so that the operator or technician may grasp the handle, tilt the mixer backwards onto the casters for easy movement of the mixer about the store floor.

In yet a further refinement, interior surfaces of the upper cabinet and the base are coated with a non-stick coating to facilitate removal of accumulated paint. In yet a further refinement of this concept, the non-stick coating is an anti-graffiti coating.

BRIEF DESCRIPTION OF THE DRAWINGS

The disclosed paint mixer is described more or less diagrammatically in the following drawings wherein:

FIG. 1 is a front perspective view of the disclosed paint mixer where the back section of the upper cabinet is in a first rearward position and the front cover of the upper cabinet is in a open position thereby providing access to a front section of the paint mixer;

FIG. 2 is a rear perspective view of the disclosed paint mixer as shown in FIG. 1;

It should be understood that the drawings are not necessarily to scale and that the disclosed embodiments are illustrated using diagrammatic representations. In certain instances, details which are not necessary for an understanding of the disclosed embodiments or which render other details difficult to perceive may have been omitted. It should be understood, that the disclosed paint mixers are not necessarily limited to the particular embodiments disclosed herein.

DETAILED DESCRIPTION OF THE PRESENTLY PREFERRED EMBODIMENTS

Figure 3:
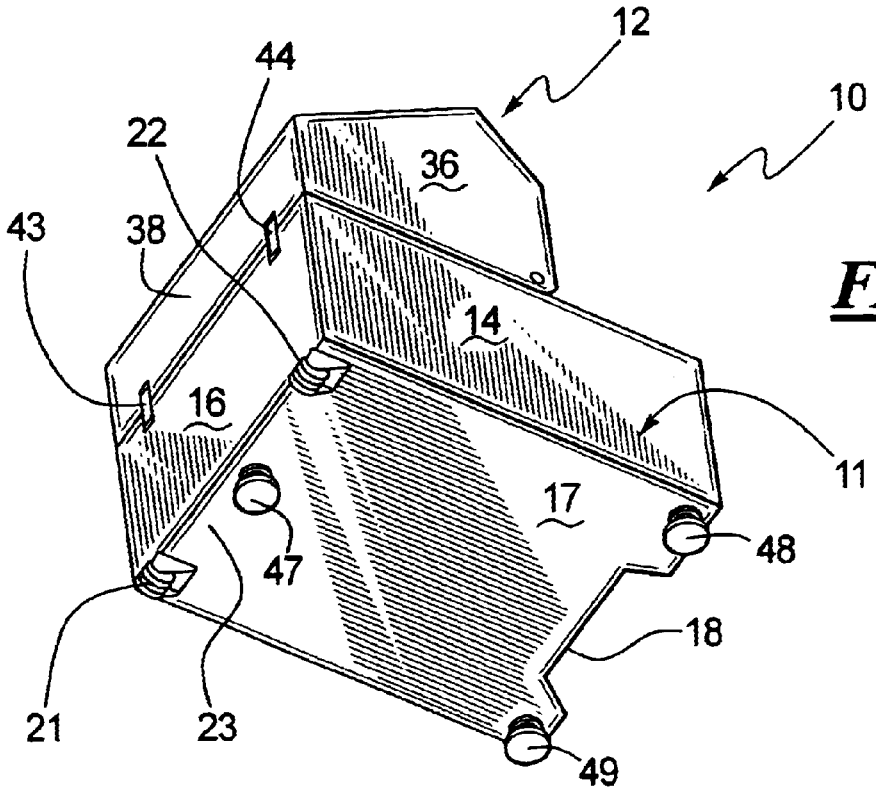
FIG. 3 is a bottom perspective view of the disclosed paint mixer as shown in FIGS. 1 and 2.

Referring first to FIG. 1, the paint mixer 10 includes a base 11 and an upper cabinet 12. In the embodiment illustrated in FIG. 1, the base 11 includes a four walled rectangular configuration including sidewalls 13, 14 (see also FIG. 2), front wall 15 and rear wall 16. The base 11 also includes a bottom wall 17 as shown in FIG. 3. The front wall 15 of the base 11 includes a recess 18 which can be used to accommodate an operator's toes or feet during movement of the mixer 10. Specifically, the operator can grasp the handle 19 mounted on the front wall 15 of the base 11, pull the front end of the mixer upward so that the weight of the mixer is shifted to the two casters 21, 22 disposed along the rear end 23 of the bottom wall 17. Use of the recess 18 enables the operator to stand closer to the mixer 11 during the moving process.

The base 11 also includes a top ledge 24 which can be considered to have a front section 25, a rear section 26 (see FIG. 4) and two connecting middle sections 27, 28. The top ledge 24 defines an interior space 29 which accommodates a paint container 31, a motor 32 (see FIG. 4) and other working parts of the mixer 10 (see also FIG. 5).

Figure 6:
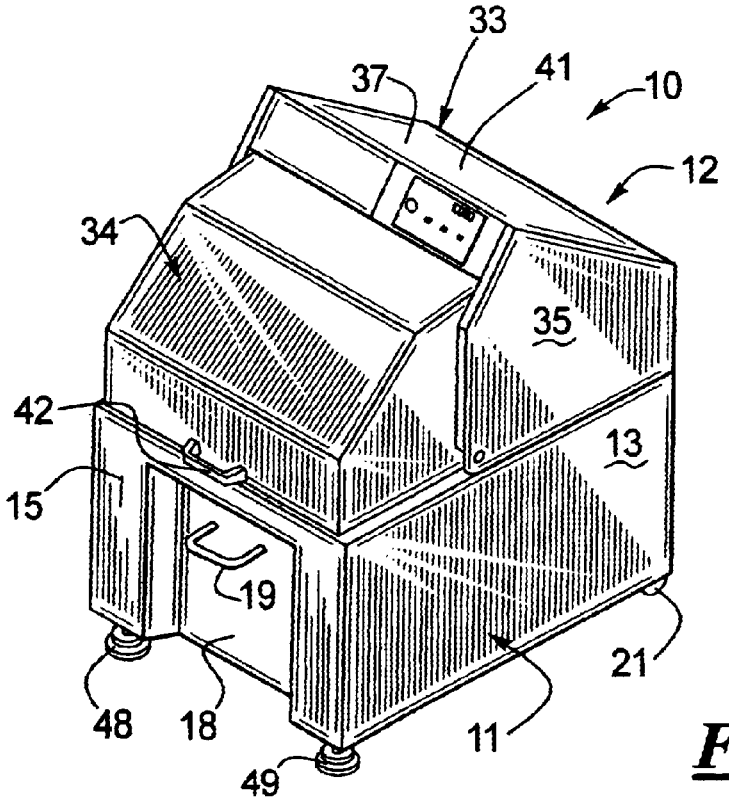
FIG. 6 is a front perspective view of the disclosed paint mixer with the back section of the upper cabinet in the first rearward position and the front cover of the upper cabinet in a closed position.

The upper cabinet 12 includes a back section 33 and a front cover 34. The front cover 34 is pivotally connected to either the back section 33 or, preferably, the base 11 or both so that the front cover may be moved from the open position shown in FIG. 1 to the closed position shown in FIG. 6. In the embodiment illustrated, the back section 33 includes sidewalls 35 and 36 (see also FIG. 2), a top wall 37 and a rear wall 38 (see FIG. 2). The sidewalls 35, 36 are pivotally connected to the base 11. The walls 35–38 of the back section 33 define an open interior 39 which accommodates the front cover 34 while the front cover 34 is in the open position as shown in FIG. 1. The open interior 39 also accommodates a portion of the paint container 31 as shown in FIG. 1. Control elements 41 may also be conveniently placed on the back section 33. However, the control elements 41 may also be located on the base 11 although location of the control elements 41 on the back section 33 or another portion of the upper cabinet 12 is ergonomically preferred. The front cover 34 also includes a handle 42.

Figure 4:
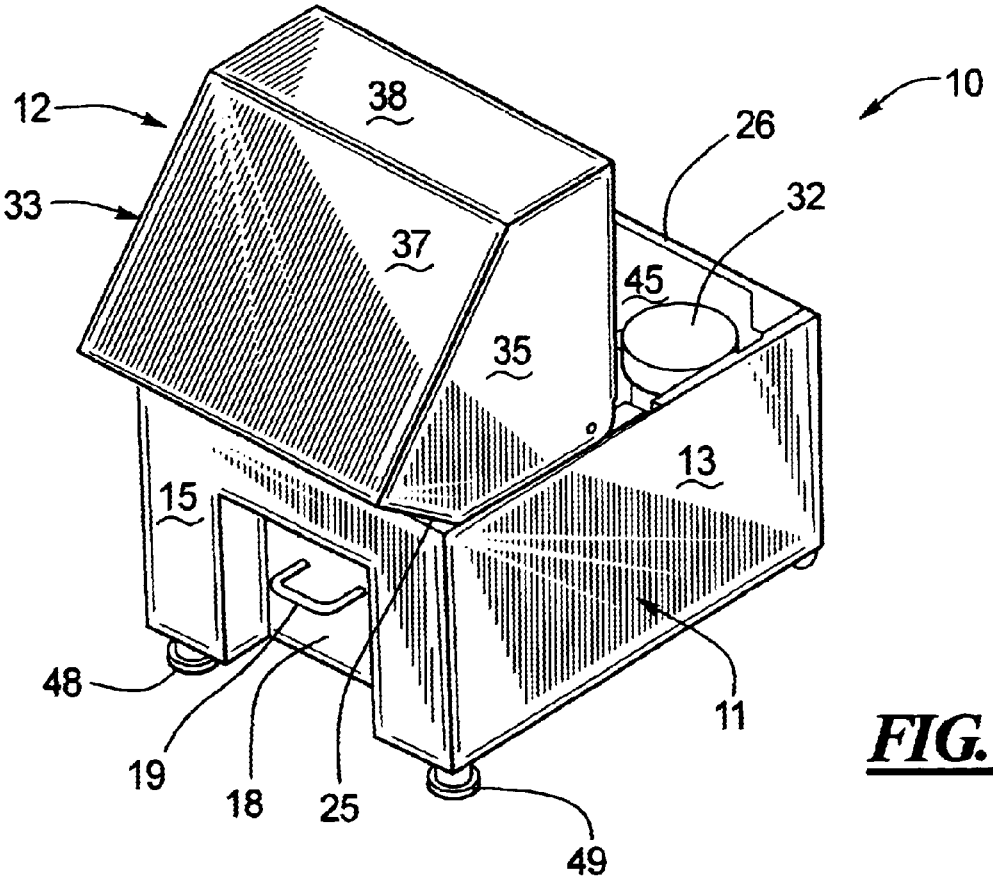
FIG. 4 is a front perspective view of the disclosed paint mixer with the back section of the upper cabinet in the second forward position thereby providing access to a rear section of the paint mixer.
Figure 5:
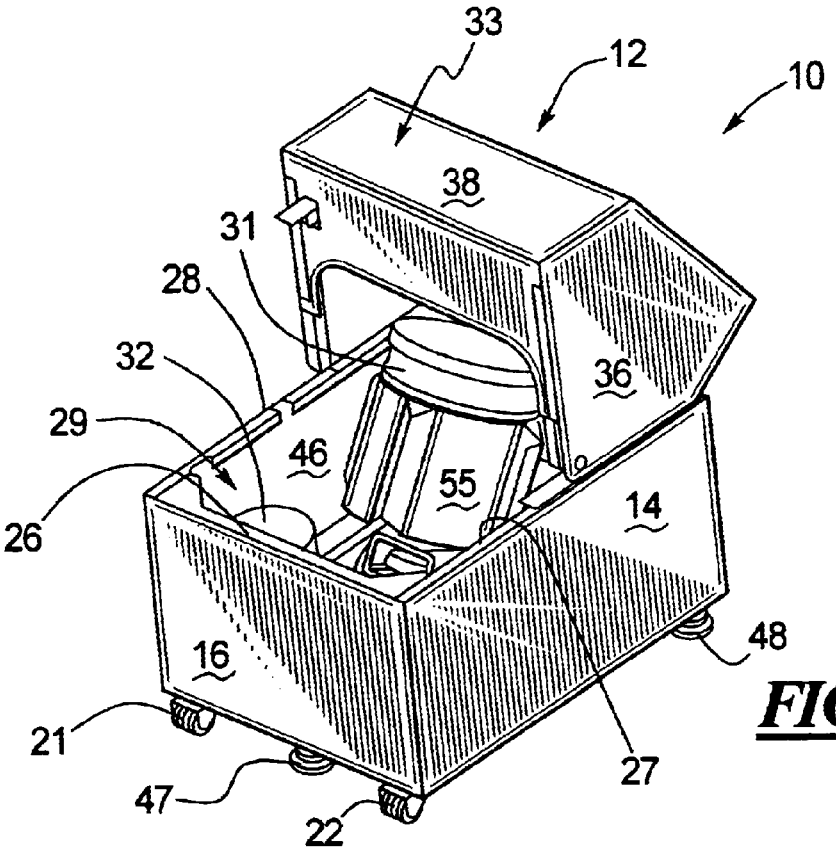
FIG. 5 is a rear perspective view of the disclosed paint mixer as shown in FIG. 4.

An important feature of the disclosed feature 10 is the ability of the upper cabinet 12 to be pivoted from the first rearward position shown in FIG. 1 to the second forward position shown in FIG. 4. Movement of the upper cabinet 12 from the position shown in FIG. 1 to the position shown in FIG. 4 greatly facilitates the servicing and cleaning of the mixer 10. This pivotal movement is achieved by the pivotal connection of the upper cabinet 12 to the base 11. Specifically, to service the mixer 10, the front cover 34 is moved to the open position shown in FIG. 1. The paint container 31 may or may not be removed at this point. The latches 43, 44 (see FIG. 2) that secure the upper cabinet 12 in place during operation of the mixer 10 are released and the back section 33 of the upper cabinet 12 is rolled or pivoted forward to the position shown in FIGS. 4 and 5. As shown.in FIGS. 4 and 5, the motor 32 and other working components of the mixer 10 are accessible for servicing and repair. Further, interior surfaces shown at 45 and 46 are also accessible for cleaning and removal of accumulated paint.

As shown in FIG. 3, the mixer 10 includes three adjustable legs or footrests 47–49. It has been found that the use of three spaced apart legs 47–49 is preferable to the use of four legs. Specifically, maintaining the adjustment of the legs 47–49 is easier. Further, the use of three legs provides superior support on uneven floor surfaces.

In a preferred embodiment, at least the inside surface of the cabinet 12, e.g., 45–46, 52–55 is coated with a non-stick coating to facilitate the removal of sprayed or accumulated paint. One preferred non-stick coating is sold under the trademark Wearlon® which is an epoxy-silicone, three component, water based room temperature cure coating that is sold by Eccotech, Inc. of Mechanicville, N.Y. It may be desirable to coat most, if not all, of the inside surfaces with the non-stick coating. Other non-stick coatings will be apparent to those skilled in the art. Many useful non-stick coatings are sold for purposes of being anti-graffiti coatings. One such suitable coating is sold under the trademark Clean Start™ by Colloid Research, Inc. of Edgemont, Pa. Another suitable coating is sold under the trademark Anti-Graphiti Clear 6072™ by Deco-Chem, Inc. of Mishawaka, Ind.

As a result, the disclosed paint mixer 10 can provide one or more numerous advantages. The pivotal connection between the upper cabinet 12 and the base 11 enables the upper cabinet 12 to assume one of two positions thereby making both the forward section 25 and rear section 26 of the base 11 accessible for maintenance and repair. Further, the pivotal connection of the upper cabinet 12 to the base 11 enables many of the inside surfaces such as 45–46 and 52–55 accessible for cleaning. Application of a non-stick coating to these inside surfaces such as 45–46 and 52–55 facilitate the removal of accumulated paint. The employment of three adjustable legs 47–49 as opposed to four adjustable legs increases the stability of the mixer 10 on an uneven floor or surface and further facilitates the adjustment of the legs 47–49 to increase the stability of the mixer 10. Still further, employment of a recess 18 for accommnodating an operator's shoe tips or toes along with the employment of the rear casters 21–22 facilitates the movement of the mixer 10 about a floor or surface. Any one or more of the above features can be incorporated into an improved paint mixer design.

While only certain embodiments have been set forth, alternative embodiments and various modifications will be apparent from the above description to those skilled in the art. These and other alternatives are considered equivalents and within the spirit and scope of this disclosure.

What is claimed:

1. A paint mixer comprising:

a base comprising an open top leading to an interior space, the interior space accommodating a paint container coupled to a motor, the base further comprising a forward section and a rear section, an upper cabinet comprising a front cover pivotally connected to a back section, the back section being pivotally connected to the base, the back section comprising a front opening defined by a front edge and that leads to an open interior for accommodating the front cover, the back section further comprising a lower edge that defines a bottom opening also leading to the open interior of the back section, the front cover further comprising a bottom edge, the back section of the upper cabinet being pivotal between a first rearward position and a second forward position, in the first rearward position, the lower edge of the back section of the upper cabinet engages the rear section of the base to provide an enclosure for the rear section of the base and the front edge of the back section of the upper cabinet extends upward from the base so that the front opening of the back section of the upper cabinet faces forward, in the second forward position, the front edge of the back section of the upper cabinet engages the front section of the base to provide an enclosure for the front section of the base and the lower edge of the back section of the upper cabinet extends upward from the base so that the bottom opening of the back section faces rearward thereby providing access to the rear section of the base, the front cover of the upper cabinet being pivotal between an open position and a closed position, in the open position, the front cover is accommodated in the open interior of the back section of the upper cabinet to provide access to the forward section of the base when the back section is concurrently in the first rearward position, in the closed position, the bottom edge of the front cover engages the forward section of the base when the back section of the upper cabinet is concurrently in the first rearward position to provide an enclosure for the forward section of the base while the back section of the upper cabinet concurrently provides an enclosure for the rear section of the base.

2. The paint mixer of claim 1 wherein the base further comprises a bottom surface, the bottom surface being connected to three spaced supports that extend downward therefrom.

3. The paint mixer of claim 2 wherein the bottom surface is also connected to two casters.

4. The paint mixer of claim 1 wherein the base further comprises a front wall having a lower end, the lower end of the front wall comprising a recess, the front wall also being connected to a handle, the base further comprises a bottom surface, the bottom surface being connected to at least one caster disposed at a rear section of the bottom surface.

5. The paint mixer of claim 1 wherein the upper cabinet comprises a plurality of inside surfaces that are coated with a non-stick coating.

6. The paint mixer of claim 5 wherein the base comprises a plurality of inside surfaces that are coated with a non-stick coating.

7. A paint mixer comprising:

a base comprising a top ledge that defines an open top leading to an interior space, the interior space accommodating a paint container coupled to a motor, the top ledge comprising a forward section and a rear section, an upper cabinet comprising a front cover pivotally connected to a back section, the back section being pivotally connected to the top ledge of the base, the back section comprising a front opening defined by a front edge and that leads to an open interior for accommodating the front cover, the back section further comprising a lower edge that defines a bottom opening also leading to the open interior of the back section, the front cover further comprising a bottom edge, the back section of the upper cabinet being pivotal between a first rearward position and a second forward position, in the first rearward position, the lower edge of the back section of the upper cabinet engages the rear section of the top ledge of the base to provide an enclosure for a portion of the open top of the base that is defined by the rear section of the top ledge of the base and the front edge of the back section of the upper cabinet extends upward from the top ledge of the base so that the front opening of the back section of the upper cabinet faces forward, in the second forward position, the front edge of the back section of the upper cabinet engages the front section of the top ledge of the base to provide an enclosure for a portion of the open top of the base that is defined by the forward section of the top ledge of the base and the lower edge of the back section of the upper cabinet extends upward from the top ledge of the base so that the bottom opening of the back section faces rearward thereby providing access to the portion of the open top of the base defined by the rear section of the top ledge of the base, the front cover of the upper cabinet being pivotal between an open position and a closed position, in the open position, the front cover is accommodated in the open interior of the back section of the upper cabinet to provide access to the portion of the open top of the base defined by the forward section of the top ledge of the base when the back section is concurrently in the first rearward position, in the closed position, the bottom edge of the front cover engages the forward section of the top ledge of the base when the back section of the upper cabinet is concurrently in the first rearward position to provide an enclosure for the portion of the open top of the base defined by the forward section of the top ledge of the base while the back section of the upper cabinet concurrently provides an enclosure for the rear section of the base.

8. The paint mixer of claim 7 wherein the base further comprises a bottom surface, the bottom surface being connected to three spaced supports that extend downward therefrom.

9. The paint mixer of claim 8 wherein the bottom surface is also connected to two casters.

10. The paint mixer of claim 7 wherein the base further comprises a front wall having a lower end, the lower end of the front wall comprising a recess, the front wall also being connected to a handle, the base further comprises a bottom surface, the bottom surface being connected to at least one caster disposed at a rear section of the bottom surface.

11. The paint mixer of claim 7 wherein the upper cabinet and the base each comprise a plurality of inside surfaces that are coated with a non-stick coating.

12. The paint mixer of claim 11 wherein the non-stick coating is an anti-graffiti coating.

13. A paint mixer comprising:

a base comprising a top ledge that surrounds and defines an open top leading to an interior space, the interior space accommodating a paint container coupled to a motor, the top ledge comprising a forward section connected to a rear section by opposing middle sections, an upper cabinet comprising a front cover pivotally connected to a back section, the back section being pivotally connected to at least one of the middle sections of the top ledge of the base, the back section further comprising a front opening defined by a front edge and that leads to an open interior for accommodating the front cover, the back section further comprising a lower edge that defines a bottom opening also leading to the open interior of the back section, the front cover further comprising a bottom edge, the back section of the upper cabinet being pivotal between a first rearward position and a second forward position, in the first rearward position, the lower edge of the back section of the upper cabinet engages the rear section and portions of the middle sections of the top ledge of the base to provide an enclosure for a portion of the open top of the base that is defined by the rear section and portions of the middle sections of the top ledge of the base and the front edge of the back section of the upper cabinet extends upward front the top ledge of the base so that the front opening of the back section faces forward, in the second forward position, the front edge of the back section of the upper cabinet engages the front section and portions of the middle sections of the top ledge of the base to provide an enclosure for a portion of the open top of the base that is defined by the forward section and portions of the middle sections of the top ledge of the base and the lower edge of the back section of the upper cabinet extends upward from the top ledge of the base so that the bottom opening of the back section faces rearward thereby providing access to the portion of the open top of the base defined by the rear section and portions of the middle sections of the top ledge of the base, the front cover of the upper cabinet being pivotal between an open position and a closed position, in the open position, the front cover is accommodated in the open interior of the back section of the upper cabinet to provide access to the portion of the open top of the base defined by the forward section and portions of the middle sections of the top ledge of the base when the back section is concurrently in the first rearward position, in the closed position, the bottom edge of the front cover of the upper cabinet engages the forward section of the top ledge of the base when the back section is concurrently in the first rearward position to provide an enclosure for the portion of the open top of the base defined by the forward section and portions of the middle sections of the top ledge of the base while the back section of the upper cabinet concurrently provides an enclosure for the rear section of the base.

14. The paint mixer of claim 13 wherein the base further comprises a bottom surface, the bottom surface being connected to three spaced supports that extend downward therefrom.

15. The paint mixer of claim 14 wherein the bottom surface is also connected to two casters.

16. The paint mixer of claim 15 wherein the base further comprises a front wall having a lower end, the lower end of the front wall comprising a recess, the front wall also being connected to a handle, the base further comprises a bottom surface, the bottom surface being connected to at least one caster disposed at a rear section of the bottom surface.

17. The paint mixer of claim 16 wherein the upper cabinet and the base each comprise a plurality of inside surfaces that are coated with a non-stick coating.

18. The paint mixer of claim 17 wherein the non-stick coating is an anti-graffiti coating.

19. A paint mixer comprising:

a base comprising an open top leading to an interior space, the interior space accommodating a paint container coupled to a motor, the base further comprising a forward section and a rear section, an upper cabinet comprising a front cover pivotally connected to a back section, the upper cabinet being pivotally connected to the base, the back section further comprising a front opening defined by a front edge, the back section further comprising a lower edge that defines a bottom opening, the front cover further comprising a bottom edge, the back section of the upper cabinet being pivotal between a first rearward position and a second forward position, in the first rearward position, the lower edge of the back section of the upper cabinet engages the rear section of the base to provide an enclosure for the rear section of the base and the front edge of the back section of the upper cabinet extends upward from the base so that the front opening of the back section of the upper cabinet faces forward, in the second forward position, the front edge of the back section of the upper cabinet engages the front section of the base to provide an enclosure for the front section of the base and the lower edge of the back section of the upper cabinet extends upward from the base so that the bottom opening of the back section faces rearward, the front cover of the upper cabinet being pivotal between an open position and a closed position, in the open position, the front cover is accommodated in the open interior of the back section of the upper cabinet, in the closed position, the bottom edge of the front cover engages the forward section of the base when the back section of the upper cabinet is concurrently in the first rearward position.

20. The paint mixer of claim 19 wherein the base further comprises a bottom surface, the bottom surface being connected to three spaced supports that extend downward therefrom.

21. The paint mixer of claim 20 wherein the bottom surface is also connected to two casters.

22. The paint mixer of claim 19 wherein the base further comprises a front wall having a lower end, the lower end of the front wall comprising a recess, the front wall also being connected to a handle, the base further comprises a bottom surface, the bottom surface being connected to at least one caster disposed at a rear section of the bottom surface.

23. The paint mixer of claim 19 wherein the upper cabinet and the base each comprise a plurality of inside surfaces that are coated with a non-stick coating.

24. The paint mixer of claim 23 wherein the non-stick coating is an anti-graffiti coating.

25. A method for servicing a paint mixer comprising a base comprising an open top leading to an interior space that accommodates a paint container and working parts for shaking the paint container, the base further comprising a forward section and a rear section, an upper cabinet comprising a front cover pivotally connected to a back section, the upper cabinet being pivotally connected to the base, the back section further comprising a front opening defined by a front edge, the back section further comprising a lower edge that defines a bottom opening, the front cover further comprising a bottom edge, the back section of the upper cabinet being pivotal between a first rearward position and a second forward position, in the first rearward position, the lower edge of the back section of the upper cabinet engages rear section of the base to provide an enclosure for the rear section the base and the front edge of the back section of the upper cabinet extends upward from the base so that the front opening of the back section of the upper cabinet faces forward, in the second forward position, the front edge of the back section of the upper cabinet engages the front section of the base to provide an enclosure for the front section of the base and the lower edge of the back section of the upper cabinet extends upward from the base so that the bottom opening of the back section faces rearward, the front cover of the upper cabinet being pivotal between an open position and a closed position, in the open position, the front cover is accommodated in the open interior of the back section of the upper cabinet, in the closed position, the bottom edge of the front cover engages the forward section of the base when the back section of the upper cabinet is concurrently in the first rearward position, the method comprising:

moving the upper cabinet to the second forward position;

servicing the working parts of the paint mixer.

26. The method of claim 25 further comprising moving the cover to the open position before moving the upper cabinet to the second forward position.

27. The method of claim 25 further comprising removing the paint container from the interior space of the base before moving the upper cabinet to the second forward position.

* * * * *